United States Patent [19]

Biersack

[11] Patent Number: 4,463,907

[45] Date of Patent: Aug. 7, 1984

[54] CUTTER WHEEL FOR BRUSH CHIPPER

[75] Inventor: Horst Biersack, Sachsen, Fed. Rep. of Germany

[73] Assignee: Crones & Co. GmbH, Ansbach, Fed. Rep. of Germany

[21] Appl. No.: 319,658

[22] Filed: Nov. 9, 1981

[30] Foreign Application Priority Data

Nov. 14, 1980 [DE] Fed. Rep. of Germany ..... 3042950

[51] Int. Cl.[3] ..... B02C 18/00

[52] U.S. Cl. ..... 241/92; 30/347; 241/278 R; 241/298

[58] Field of Search ..... 30/347, 348, 351, 357, 30/299; 241/92, 278 R, 298; 144/176; 99/593

[56] References Cited

U.S. PATENT DOCUMENTS

| | | | |
|---|---|---|---|
| 532,509 | 1/1895 | Whiting | 30/349 |
| 1,469,283 | 10/1923 | Storz | 30/349 |
| 2,646,223 | 7/1953 | Quintilian | 241/278 R |
| 3,266,539 | 8/1966 | Gantt | 144/176 |
| 3,690,571 | 9/1972 | Luthi et al. | 241/92 X |

FOREIGN PATENT DOCUMENTS 2934792 3/1981 Fed. Rep. of Germany .

*Primary Examiner*—E. R. Kazenske
*Assistant Examiner*—Douglas D. Watts
*Attorney, Agent, or Firm*—Karl F. Ross; Herbert Dubno

[57] ABSTRACT

A cutter wheel for a brush chipper or the like has a support plate generally centered on, extending perpendicular to, and rotatable in a predetermined rotational sense about a central support axis. This plate is formed with a plurality of slots angularly equispaced about and radially equispaced from the support axis and with a plurality of screw holes each trailing a respective slot relative to the rotational sense. A plurality of blades each have an annular outer periphery formed as a succession of cutting edges. The outer peripheries of the blades are centered on respective blade axes and each blade has at the respective blade axis a throughgoing attachment hole. Respective attachment screws engage through the attachment holes with the screw holes, with one of the cutting edges directed forwardly in the rotational sense of the support plate. Thus with this system a new cutting edge can be brought up simply by loosening the respective screw and rotating the blade, then tightening the screw.

8 Claims, 5 Drawing Figures

CUTTER WHEEL FOR BRUSH CHIPPER

FIELD OF THE INVENTION

The present invention relates to a brush chipper. More particular this invention concerns a cutter wheel with removable blades for such a chipper.

BACKGROUND OF THE INVENTION

A brush chipper such as described in my German patent document No. 2,934,792 has a housing formed with an upwardly open funnel-shaped inlet hopper centered on a vertical axis and opening downwardly into a chipping or comminution chamber into which a lateral inclined intake also opens. This housing is provided with a shaft supported on bearings and provided at its lower end with a V-belt pulley connected by a belt to a pulley on the output shaft of a drive motor so that this shaft can be rotated by the motor about its axis.

A nut secures a blade-support plate to the upper end of this shaft, with the plate perpendicular to the axis. in addition this nut bolts a plate having a plurality of upwardly extending arms to the upper side of this support plate. These arms lie above baffles fixed in the comminution chamber. The blade plate is provided with blades bolted in place behind, relative to the normal rotation direction of the blade plate, radially outwardly open slots formed by bending down of tabs.

Brush to be chipped is fed into either of the intakes. The brush entering via the intake funnel is broken up by the arms coacting with the baffles and then, like the brush or sticks entering via the lateral intake, is chopped up by the blades to pass through the wheel at the slots ahead of the blades. Thence the chips pass radially out of the machine through a radially outwardly open discharge to be deflected downwardly by a plate into an appropriate receptacle.

These blades are normally rectangular with two opposite long sides ground to straight cutting edges. Two screws secure each blade in place behind the respective slot, with the cutting edge extending radially of the axis. Such a blade can be taken off and turned over to use its second edge when the first becomes dull. As a rule the blades to dull rather rapidly, since in addition to cutting wood, they inevitably encounter dirt, small stones, and even an occasional nail or other metal object. Hence the blades must be flipped and/or replaced fairly frequently.

Whether the blade is simply being turned over to use its other edge, or replaced with a new blade, it is necessary to fully withdraw the two screws and reinsert them once the blade has been repositioned or a new blade has been put in. Such a job is fairly onerous, and the occasional screw is dropped into and lost in the mechanism of the machine, further complicating matters.

OBJECTS OF THE INVENTION

It is therefore an object of the present invention to provide an improved cutter wheel for a brush chipper.

Another object is the provision of such a cutter wheel for a brush chipper which overcomes the above-given disadvantages.

Yet another object is to provide a cutter-wheel arrangement which allows a new cutting edge to be brought into poition in a manner that is substantially easier than the prior-art method.

SUMMARY OF THE INVENTION

These objects are attained according to the instant invention in a cutter wheel for a brush chipper or the like. The wheel according to this invention has a support plate generally centered on, extending perpendicular to, and rotatable in a predetermined rotational sense about a central support axis. This plate is formed with a plurality of slots angularly equispaced about and radially equispaced from the support axis and with a plurality of screw holes each trailing a respective slot relative to the rotational sense. A plurality of blades each have an annular outer periphery formed as a succession of cutting edges. The outer peripheries of the blades are centered on respective blade axes and each blade has at the respective blade axis a throughgoing attachment hole. Respective attachment screws engage through the attachment holes with the screw holes, with one of the cutting edges directed forwardly in the rotational sense of the support plate.

Thus with the system according to the present invention a new cutting edge can be brought up simply by loosening the respective screw and rotating the blade, then tightening the screw. The blade need not even be disconnected to allow such renewal of the cutting edge, and a blade can have more than two such edges. Since only one attachment hole need be formed in each such blade, the blade is not weakened, unlike the prior-art structures wherein several holes considerably weaken the blade.

According to another feature of the invention the slots are arcuate and have centers of curvature at the respective screw holes. Furthermore the blades have cupped faces centered on the respective blade axes and turned toward the support plate. The blades are limitedly elastically deformable so that they can be clamped tightly in place by the respective screws.

The cutter wheel according to this invention further comprises means including interengaging formations on the plate and blades and angularly equispaced about the screw holes for locking of each of the blades on the plate in any of a plurality of positions angularly offset about the respective blade axis. Thus for each cutting edge there are coacting formations which engage together to position the respective cutting edge to face forwardly in the blade rotational sense.

These formations include, according to the invention, at least one bump projecting from each of the blades toward the plate and respective pluralities of recesses in the plate angularly equispaced about the screw holes, the bump of each blade being engageable in any of the respective recesses. One such recess is provided for each cutting edge.

It is also possible for the formations to include a plurality of angularly spaced formations on each of the blades and at least one formation on the plate adjacent each of the screw holes.

The blade-support plate has a lower surface turned away from the blades and provided with feed formations. These feed formations are formed as bent-down tabs immediately behind further slots in the support plate. Material cut up small enough to pass through the slots at the tabs or at the blades is advanced by these tabs and expelled from the chipper.

The blades according to the invention may have circular peripheries. Thus the cutting edges will be continuous, end-to-end and will be on the same center of curvature. it is also possible for the peripheries to be polygonal, so that the individual cutting edges are straight. When the blade periphery is circular the cutting edges can be formed by a frustoconical outer periphery and an annular upper outer-edge region lying in a plane perpendicular to the respective blade axis and meeting the frustoconical periphery at a circular line. In any case the outer blade edges are frustoconical and centered on the respective blade axes.

DESCRIPTION OF THE DRAWING

The above and other features and advantages will become more readily apparent from the following, reference being made to the accompanying drawing in which.

SPECIFIC DESCRIPTION

Figure 5:
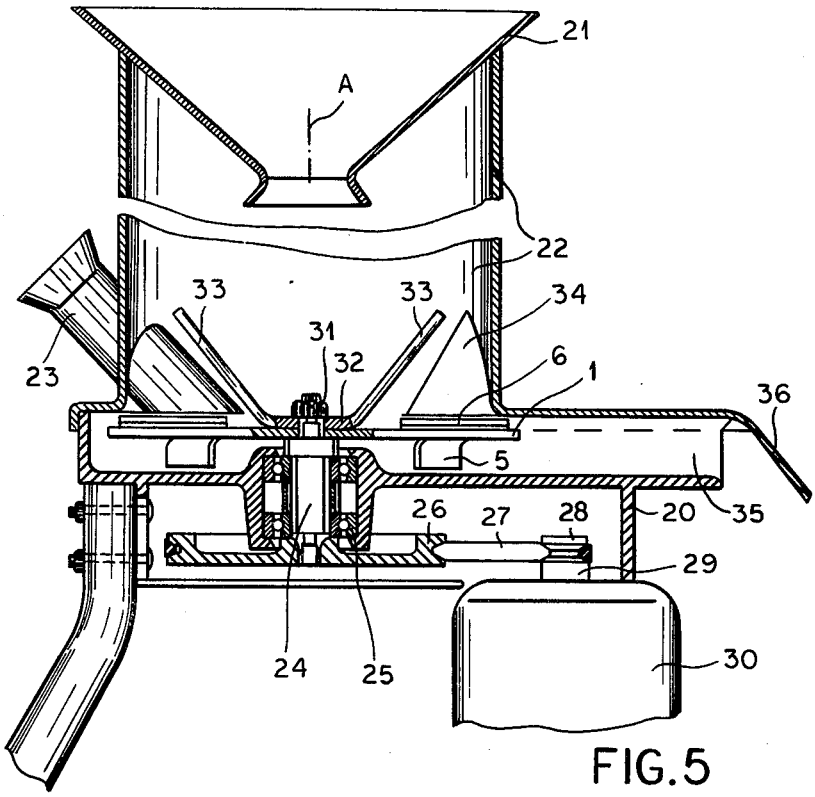
FIG. 5 is a small-scale vertical section through a brush chipper according to the present invention.

As shown in FIG. 5 a brush chipper of the type described in my above-cited German patent document 2,934,792 has a housing 20 formed with an upwardly open funnel-shaped inlet hopper 21 centered on a vertical axis A and opening downwardly into a chipping or comminution chamber 22 into which a lateral inclined intake 23 also opens. This housing is provided with a shaft 24 supported on bearings 25 and provided at its lower end with a V-belt pulley 26 connected by a belt 27 to a pulley 28 on the output shaft 29 of a drive motor 30 so that this shaft 24 can be rotated by the motor 30 about the axis A.

A nut 31 secures a support plate 1 to the upper end of this shaft 24, with the plate 1 perpendicular to the axis A. In addition this nut 31 bolts a plate 32 having a plurality of upwardly extending arms 33 to the upper side of this plate 1. These arms 33 lie above baffles 34 fixed in the chamber 22. The plate 1 is provided with blades 6 described in more detal below, and is formed with radially outwardly open slots 4 (See FIG. 1.) formed by bending down of tabs 5.

Brush to be chipped is forced into either of the intakes 21 or 23. The brush entering via the intake funnel 21 is broken up by the arms 33 coacting with the baffles 34 and then, like the brush or sticks entering via the intake 23, is chopped up by the blades 6 to pass through the wheel 1 either at the slots 4 or at slots 10 (see FIG. 1.) ahead of the blades 6. Thence the chips pass radially out of the machine through a radially outwardly open discharge 35 to be deflected downwardly by a plate 36 into an appropriate receptacle.

Figure 1:
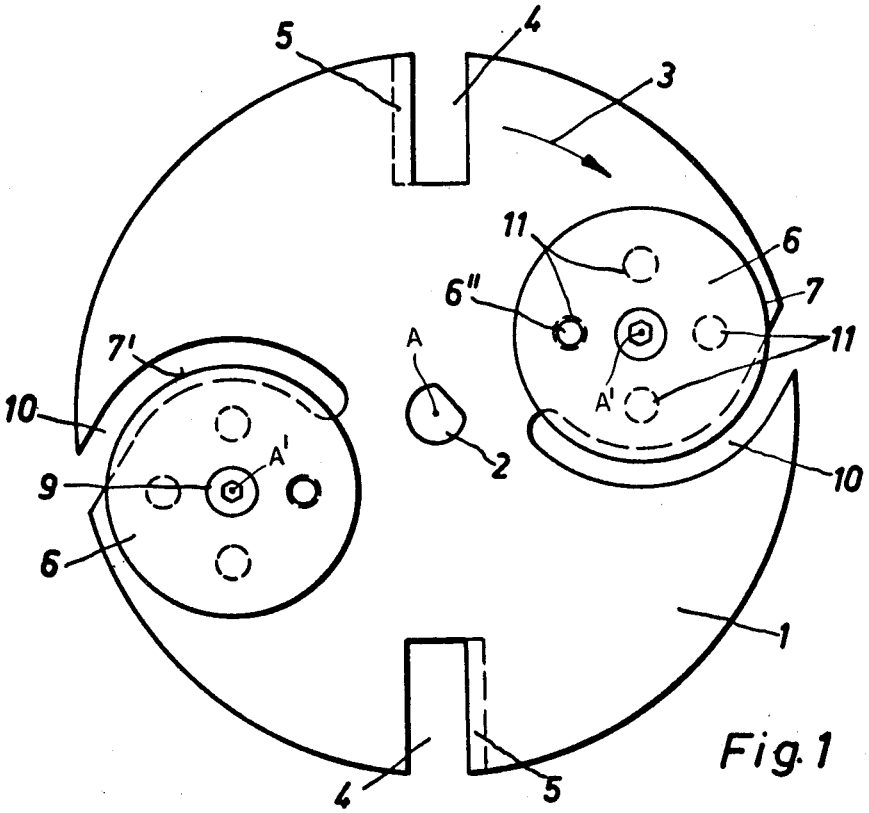
FIG. 1 is a top view of the cutter wheel according to this invention.
Figure 2:
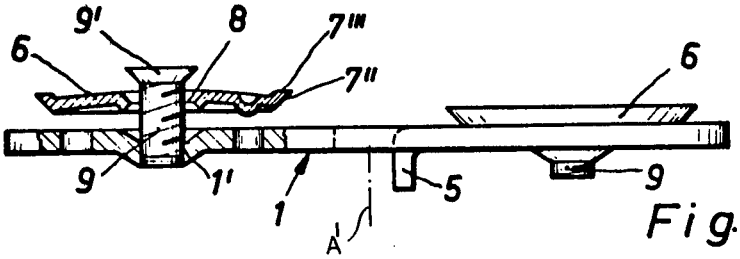
FIG. 2 is a side view, partly in section, of the wheel shown in FIG. 1.
Figure 3:
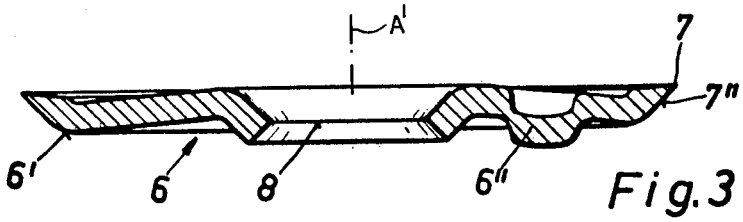
FIG. 3 is a blade in large-scale axial section.

The cutter wheel according to the instant invention, as shown in FIGS. 1 and 2, has two such blades 6 spaced diametrally opposite each other relative to a flatted central hole 2 through which the correspondingly shaped bolt 24 passes. These blades 6 are of circular section, having an outer edge 7 formed by a frustoconical outer periphery 7'' meeting an annular upper region 7''' at a circular line forming the cutting edge. The region 7''' lies in a plane perpendicular to an axis A' on which the blade 6 is centered. In addition the blades 6 have dished lower surfaces forming an annular lower region 6' that contacts the upper face of the mainly planar support plate or disk 1. These blades 6 are each formed offset from the axis A' with a downwardly projecting pump 6'' and at the axis A' with a central attachment hole 8 through which the allen screw 9 passs.

The support plate 1 is generally circular in shape. The slots 4 formed by bending down of the tabs 5 are rectangular and extend radially. The grooves 10 in front relative to the normal rotation direction 3 are arcuate and centered on the axes A' of the respective blades 6. In addition this plate 1 is formed at each of the axes A' with a threded hole 1' into which the screw 9 fits, with the head 9' of the screw 9 pressing the respective blade 6 down against the upper plate surface. Angularly equispaced about each hole 1' are four recesses or holes 11 in which the respective boss or bump 6'' can engage.

Figure 4:
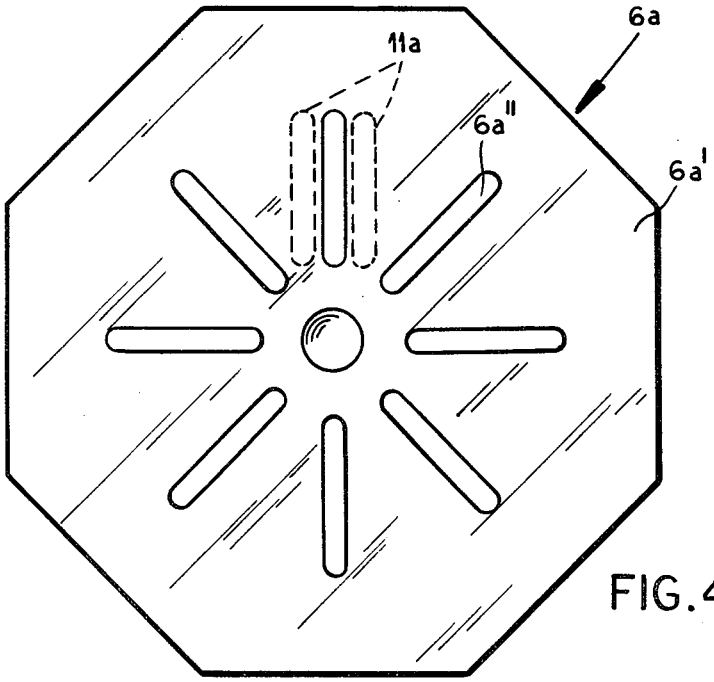
FIG. 4 is a top view of another blade according to this invention.

It is also possible as shown in FIG. 4 to use an octagonal blade **6*a* having eight straight cutting edges 6*a'***. *In addition this blade 6a* is formed with six ridges **6*a''* functionally identical to the bosses 6'' and adapted to fit between a pair of ridges such as shown in dashed lines at 11*a* which are formed on and extend radially on the plate 1** from the respective axis A'. This arrangement therefore allows the blade to be angularly indexed eight times.

With the system according to the instant invention when the cutting edge being used becomes dull the user need merely loosen—not remove—the screw 9 of that blade 6, rotate the blade 6 through an angular increment to expose an unused cutting edge, and then tighten the screw 9. This can be done very easily right on the job, and permits the cutting edges to be renewed even by a relatively unskilled worker. What is more, the blades 6 or **6*a*** can relatively easily be reground, and can be produced at low cost so that replacing them entirely does not entail a large expense.

I claim:

1. A cutter wheel for a brush chipper or the like, said wheel comprising:

a support plate generally centered on, extending perpendicular to, and rotatable in a predetermined rotational sense about a central support axis, said plate being formed with a plurality of slots angularly equispaced about and radially equispaced from said support axis and with respective screw holes trailing the slots relative to said rotational sense the support plate having an axially directed plate face;

a plurality of blades each having an annular periphery forming an annular cutting edge, said blades being centered on respective blade axes and each having at the respective blade axis a throughgoing attachment hole and each having a blade face turned toward the plate face;

respective attachment screws engaged through said attachment holes with said screw holes with any portion of said cutting edge directed forward in said rotational sense and the respective blades fixed on the support plate, whereby the attachment screws can be loosened to allow angular displacement of the blades thereon to expose a fresh portion of the respective edge at the respective slot;

means including interengaging formations on said plate and blades and angularly equispaced about said screw holes for locking of each of said blades on said plate in any of a plurality of positions angularly offset about the respective blade axis and in each of which a respective cutting edge is directed forward in said rotational sense, the interengaging formations including a plurality of recesses on one of said faces and a bump on the other face selectively engageable in the recesses.

2. The cutter wheel defined in claim 1 wherein said slots are arcuate and have centers of curvature at the respective screw holes.

3. The cutter wheel defined in claim 2 wherein said blades have cupped faces centered on the respective blade axes and turned toward said support plate, said blades being limitedly elastically deformable.

4. The cutter wheel defined in claim 3 wherein said blades have generally frustoconical outer edges centered on the respective blade axes.

5. The cutter wheel defined in claim 1 wherein said formations include a plurality of angularly spaced formations on each of said blades and at least one formation on said plate adjacent each of said screw holes.

6. The cutter wheel defined in claim 1 wherein said plate has a lower surface turned away from said blades and provided with feed formations.

7. The cutter wheel defined in claim 1 wherein said peripheries are circular.

8. The cutter wheel defined in claim 7 wherein said blades each have respective cutting edges formed by a frustoconical outer periphery and an annular upper outer-edge region lying in a plane perpendicular to the respective blade axis and meeting said frustoconical periphery at a circular line.

* * * * *